United States Patent [19]

Olive' et al.

[11] Patent Number: 4,507,324

[45] Date of Patent: Mar. 26, 1985

[54] ANTISOILING NYLON CARPET YARNS

[75] Inventors: Salvador Olive'; Gisela Olive', both of Cantonment, Fla.

[73] Assignee: Monsanto Company, St. Louis, Mo.

[21] Appl. No.: 538,399

[22] Filed: Oct. 3, 1983

Related U.S. Application Data

[63] Continuation-in-part of Ser. No. 470,734, Mar. 7, 1983, abandoned, and Ser. No. 479,194, Apr. 1, 1983, abandoned, said Ser. No. 470,734, is a continuation of Ser. No. 395,538, Jul. 6, 1982, abandoned, said Ser. No. 479,194, is a continuation of Ser. No. 398,054.

[51] Int. Cl.[3] ..... D02G 3/00

[52] U.S. Cl. ..... 428/375; 428/395; 427/393.4; 8/115.6; 525/183

[58] Field of Search ..... 428/395, 394; 57/250; 427/393.4, 394; 525/183; 8/115.6

[56] References Cited

U.S. PATENT DOCUMENTS

| | | | |
|---|---|---|---|
| 3,617,355 | 12/1971 | Loffler et al. | 8/115.6 |
| 3,836,496 | 9/1974 | Dickson | 260/29.6 |
| 3,912,681 | 10/1975 | Dickson | 260/29.6 |
| 3,914,225 | 10/1975 | Niestand et al. | 8/115.6 |
| 4,043,965 | 8/1977 | Dickson | 260/29.6 |
| 4,168,954 | 9/1979 | Marco | 8/115.6 |
| 4,169,061 | 9/1979 | Carver et al. | 8/115.6 |
| 4,337,155 | 6/1982 | Sasaki et al. | 428/395 |
| 4,386,132 | 5/1983 | Dille et al. | 428/372 |

FOREIGN PATENT DOCUMENTS 1352975 5/1974 United Kingdom .

OTHER PUBLICATIONS

Textile Research Journal, Jul., 1953, pp. 462–468, "The Reaction of Polyacrylic Acid with Nylon", A. C. Nuessle and R. F. Crawford.

*Primary Examiner*—George F. Lesmes
*Assistant Examiner*—Beverly K. Johnson
*Attorney, Agent, or Firm*—John W. Whisler

[57] ABSTRACT

Polyamide carpet fibers coated with a certain class of fluorine-containing addition polymer are described. The coating is chemically bonded to the fiber surface through amide linkages (—NHCO—) of the polyamide. The coating imparts antisoiling properties of a permanent nature to the fibers. Where applied to carpet yarn, the coating has good retention through carpet dyeing operations and does not significantly interfere with the ability of the carpet to take up dye, even in the case of foam dyeing which is particularly sensitive to fluorocarbon coatings.

15 Claims, No Drawings

ANTISOILING NYLON CARPET YARNS

BACKGROUND OF THE INVENTION

This application is a continuation-in-part of application Ser. No. 470,734, filed Mar. 7, 1983, and now abandoned application Ser. No. 479,194, filed Apr. 1, 1983 and now abandoned; application Ser. No. 470,734 is a continuation of application Ser. No. 395,538, filed July 6, 1982 and now abandoned; and application Ser. No. 479,194 is a continuation of application Ser. No. 398,054, filed July 14, 1982 and now abandoned.

FIELD OF THE INVENTION

This invention relates to polyamide fibers coated with a certain class of fluorine-containing addition polymers. The coating imparts antisoiling properties to the fibers and is chemically bonded to the fiber surface. The chemical bonding of the coating to the fiber surface imparts antisoiling properties of a permanent nature to the fiber. The term "fibers" as used herein means fibers in the form of either continuous filaments or staple. The term yarn as used herein means a continuous strand of fibers.

DESCRIPTION OF THE PRIOR ART

Considerable research and development efforts have been directed to providing carpeting having good antisoiling properties. It is generally known that the antisoiling properties of carpeting can be improved by treating either the pile of the finished carpeting or the yarns from which the carpeting pile is constructed with an antisoiling agent. Fluorine-containing compounds (referred to hereinafter as fluorochemicals), although expensive, are generally considered to be the best choice of antisoiling agents for this purpose. The fluorochemicals are conventionally applied to the carpet pile or yarn surface from an aqueous medium. The surface is then dried to remove the water and leave the fluorochemical behind as a coating, with the coating being held to the surface by van der Waals attractive forces. Under such conditions, if the fluorochemical is applied to the yarn rather than to the finished carpeting pile, a significant amount of fluorochemical comes off from the yarn during normal carpet dyeing operations. This requires that the yarn be initially coated with a greater amount of the expensive fluorochemical than is actually needed in the carpet.

SUMMARY OF THE INVENTION

In accordance with the present invention polyamide fibers useful in the construction of carpeting are provided having, as a coating, a fluorine-containing addition polymer chemically bonded to the fiber through amide linkages of the polyamide. The addition polymer is characterized in having a carbon-carbon backbone and substituent groups pendant therefrom, some of which contain fluorine atoms attached directly to aliphatic carbon atoms and others of which are capable of chemically bonding to the polyamide fiber through chain-extending amide groups or linkages (e.g. —NHCO—). The coated fibers are characterized in that the addition polymer contains a sufficient amount of fluorine to provide at least 100 parts per million (ppm) of fluorine, based on the weight of the fibers (o.w.f.). The fluorine of the coating imparts excellent antisoiling properties (including antistaining and soil release properties) to the fibers and fabrics made therefrom.

The coated fibers of the invention are conveniently prepared, for example, by coating the polyamide fibers with an aqueous dispersion of the addition polymer and then heating the coated fibers under conditions of time and temperature sufficient to dry the fibers and effect chemical bonding between the polyamide fibers and the addition polymer, for example, at a temperature of 190° C. for a period of about 10 minutes. The fibers may be in the form of yarn or in fabric form (e.g. carpet pile). Chemical bonding of the addition polymer to the polyamide fiber is believed to take place, at least in part, by trans-amidation in which, for example, carboxylic acid substituent groups of the addition polymer react with amide linkages (—NHCO—) of the polyamide according to the following mechanism:

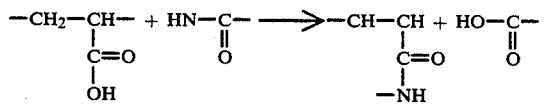

Chemical bonding of the addition polymer to the polyamide fiber greatly improves the retention of the polymer to the fiber during normal carpet dyeing operations and over the life of the carpet. When applied to carpet yarn, the coating does not significantly interfere with the ability of the yarn to take up dye, even in the case of foam dyeing, which is particularly sensitive to fluorocarbon coatings.

PREFERRED EMBODIMENTS OF THE INVENTION

Addition polymer useful in preparing the coated fibers of the present invention have a carbon-carbon backbone and substituent groups pendant therefrom, some of which are capable of chemically bonding to polyamide fiber through amide linkages of the polyamide (such groups being referred to herein as "reactive groups") and others of which contain fluorine atoms attached to aliphatic carbon atoms (such groups being referred to herein as "fluorine-containing groups"). In general, the addition polymers comprise repeating units of the formula

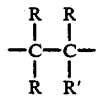

and of the formula

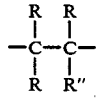

where R is hydrogen or a group that is nonreactive with amide linkages of polyamides (such groups being referred to herein as "non-reactive groups"), R′ is a reactive group, such as, a carboxylic acid group (e.g. —COOH— or $CH_2COOH$), a phenol, alcohol, phosphate, phosphite, phosphonate, sulfate or sulfonate group, and R″ is a fluorine-containing group. The addition polymers are conveniently prepared by reacting one or more monomers of the formula

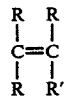

(Component A) with one or more monomers of the formula

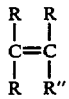

(Component B) in a mole ratio ranging from 1:10 to 10:1 under conditions selected to effect polymerization. In general, if the Component A content of the polymer is less than about 10 mole %, there will not be sufficient chemical bonding between the addition polymer and polyamide to prevent significant losses of the coating during carpet dyeing operations. On the other hand, if the Component B content of the polymer is less than about 10 mole %, the antisoiling properties of the coated fiber will not be significantly enhanced. In any event, the addition polymer should contain a sufficient amount of Component B to provide a coated fiber containing at least 100 ppm of fluorine o.w.f. When the coated fibers comprises less than about 100 ppm of flourine, the antisoiling properties of the fibers are not significantly enhanced for carpet applications. Preferably, the coated fibers comprises 300 to 1500 ppm of fluorine o.w.f. In general, increasing the ppm of fluorine above about 1500 ppm o.w.f. does not significantly increase the antisoiling properties of the fibers. Representative Component A monomers that may be used in preparing the addition polymers include, but are not limited to, acrylic acid (AA), methacrylic (MAA) and other organic acids. Representative Component B monomers that may be used in preparing the addition polymers include, but are not limited to, perfluoroalkyl acrylates or methacrylates of the general formula $CF_3(CF_2)_xC_nH_{2n}OOCCR{=}CH_2$, for example, 1,1-dihydroperfluorooctyl methacrylate (FOM) and the corresponding acrylate(FOA), and sulfamides, such as,

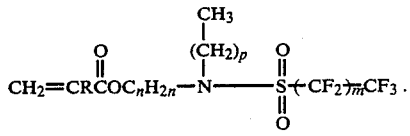

where R has the same meaning as previously defined, x is an integer from 5 to 11; n is 0, 1 or 2; m is 3 to 15; and p is 0, 1, 2 or 3. Preferably, x is an integer from 5 to 9, n is 2, m is 7 and p is 0. Mixtures of the monomers may also be used; for example, mixtures of perfluoroalkyl acrylates where x ranges from 5 to 11.Generally, when selecting commercially available monomers for use in preparing the addition copolymers, R will be hydrogen or a lower alkyl group such as methyl or ethyl.

Addition polymers useful in practicing the present invention may conveniently be prepared by an aqueous emulsion polymerization techniques under conditions that favor formation of block copolymers. According to this technique Component A (e.g., acrylic acid) and Component B (e.g., 1,1-dihydroperfluorooctyl acrylate) are polymerized in the presence of water, a free radical initiator (e.g., $K_2S_2O_8$) and an emulsifier (e.g., sodium lauryl sulfate). The acrylic acid and initiation dissolve in the water phase and the acrylate (FOA) does not. The emulsifier is added in a concentration above the critical micelle concentration and forms micelles which are in equilibrium with dissolved emulsifier molecules. The water insoluble acrylate monomer (FOA) is solubilized in the miscelles. Although the resulting product is mostly block copolymer, it contains some random copolymer. Also, the block copolymer is not completely soluble in solvents which would be expected to dissolve the copolymer (e.g. N,N-dimethylacetamide, N,N-dimethylformamide and hexafluoroisopropanol), indicating that the copolymer is branched or crosslinked. Random copolymers can be similarly prepared by carrying out the foregoing emulsion polymerization in the presence of a strong election donor, such as N,N-dimethylformamide (DMF). In this instance the acrylic acid monomer forms water insoluble complexes and most of the acrylic acid is in the DMF phase along with the FOA, whereby a random copolymer or acrylic acid and FOA is formed. This product, however, is also a mixture of random and block copolymers but in this instance it is mostly random copolymer.

According to one embodiment of the invention, the addition polymer contains, in addition to repeating units of formulas (I) and (II), repeating units of the formula

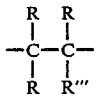

where R is as previously defined and R''' is a nonreactive group (i.e. a group nonreactive with amide linkages) such as

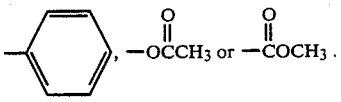

According to this embodiment, the addition polymer is prepared by copolymerizing in addition to Component A and Component B, a third component (Component C) comprising one or more other vinyl monomers of the formula

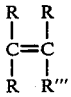

copolymerizable with Components A and B, such as styrene (Sty), vinyl acetate (VA), methyl methacrylate (MA), vinyl chloride (VC), vinylidene chloride (VDC), vinyl pyrrolidone (VP). Addition polymers containing Component C may be in the form of random copolymers or block copolymers, including block copolymers in which one or more of the blocks consist of a random copolymer, for example, a block copolymer consisting of acrylic acid blocks and blocks consisting of a random compolymer of FOA and Styrene or a block copolymer consisting of AA/FOA/Sty, MAA/FOM/Sty, AA/-FOA/VA and MAA/FOM/Sty/VA. When Component C is used in forming addition polymers suitable for use in practicing the present invention, preferably, at least 10 mole % of the monomers should comprise Component A monomers and another 10 mole % should comprise Component B.

The fluorine-containing addition polymer is conveniently applied to polyamide fibers from a finish comprising an aqueous dispersion of the polymer. Preferably the fibers are in the form of a yarn. The finish may be applied to the fibers in a conventional manner, for example, by spraying the finish onto fibers of a polyamide yarn or by passing such a yarn over a freely rotating roll (finish roll) partially immersed in a bath of the finish or by any other suitable means. The polyamide yarn to which the finish has been applied is heated under conditions of time and temperature sufficient to dry the yarn and effect chemical bonding of the polymer to the polyamide fibers of the yarn. If desired, however, pile fibers of finished carpeting may be similarly treated to provide the coated fibers.

The fluorine-containing addition polymer may be applied to any polyamide fiber in accordance with the present invention. Polyamide fibers of major commercial importance are those shaped from nylon and, especially, those shaped from nylon 66 which is polyhexamethylene adipamide and those shaped from nylon 6 which is polycaprolactam. Other polyamides from which the fibers may be shaped include: nylon 11 which is the polymer of 11-amino undecanoic acid; nylon 610 which is polyhexamethylene sebacamide; and copolymers of nylon 66 or nylon 6 in which a portion of the nylon 66 or nylon 6 monomers are replaced by other monomers copolymerizable therewith, for example, a nylon 66/6 copolymer or nylon 66/6TA copolymer where 6TA is hexamethylene terephthalamide.

Although it is intended that the coated fiber of the present invention may be used in all textile applications, the fibers have particular value for carpet yarn applications where there has been a need to provide a fluorocarbon-coated yarn having good retention and abrasion resistance of the coating through carpet dyeing operations. The fibers of the present invention fulfill this need.

The following examples are given to further illustrate the invention. In the examples, "ppm of fluorine" means parts by weight of fluorine per million parts by weight of nylon yarn; "F-Retention" means the weight ratio of fluorine on the yarn just after dyeing to that on the yarn just prior to dyeing expressed as a percentage; and "C-16 Contact Angle" means the contact angle in degrees of droplets of linear hexadecane (C-16) on the coated nylon surface. The highest possible angle obtainable with a fluorochemical is about 76 degrees. Percentages given in the example are weight percentages.

EXAMPLE I

In this example six aqueous dispersions, each containing one of the copolymers of methacrylic acid (MAA) and 1,1-dihydroperfluorooctyl methacrylate (FOM) listed in Table I, are prepared using the following procedure which favors formation of block copolymers. 230 ml of water and 5 g of sodium lauryl sulfate are added to a 500 ml flask and heated to 80° C. under nitrogen. 1.0 g of catalyst ($K_2S_2O_8$) is added and dissolved. 20 g of FOM and an amount of methylacrylic acid corresponding to the monomer ratio shown in Table I below are then added. The contents of the flask are heated to and maintained at 80° C. for one hour with stirring to effect polymerization of the monomers. The contents of the flask (comprising an aqueous dispersion containing FOM/MAA copolymer and a precipitate containing byproducts such as MAA homopolymer) and then cooled to room temperature and aqueous dispersion is decanted from the precipitate. Two sets of nylon 66 films were coated with the aqueous dispersions of the copolymers. Analysis indicates the product to be mostly 2 block copolymer containing a small amount of random copolymer. Each set of films consists of six films each coated with one of the copolymers dispersions. Each coated film was prepared by immersing the film in one of the dispersions for 10 seconds and then removing the excess dispersion from the film with blotting paper. As shown in Table I, one set of the films was heat-treated in a laboratory oven for 10 minutes at 190° C. to effect chemical bonding of the FOM/MAA copolymer to the nylon 66 film. The other set of films was not heat treated. All of the coated films were then blank dyed at the boil for one hour in a blank dyeing solution. (Blank dyeing simulates normal carpet dyeing conditions.) The solution was prepared by dissolving $10^{-2}$ moles of each phosphoric acid, boric acid and acetic acid in 500 ml of water, then adjusting the pH to 4.0 with NaOH and finally diluting with water to a total volume of 1000 ml. The contact angle of droplets of linear hexadecane on the surface of each nylon film is then measured and given in Table I, below, along with other data relating to the coated films. The contact angles were measured using a commercially available goniometer designed for measuring such angles.

TABLE I

| Film | Molar Ratio FOM/MAA | Dispersion Copolymer g/l | Dispersion Fluorine % | C-16 Contact Angle (degrees) Blank-Dyed Unheated | C-16 Contact Angle (degrees) Blank-Dyed Heated |
|---|---|---|---|---|---|
| A | 0.05 | 30 | 0.26 | 0 | 38 |
| B | 0.08 | 32 | 0.57 | 0 | 53 |
| C | 0.13 | 31 | 0.78 | 0 | 60 |
| D | 0.33 | 25 | 1.0 | 10 | 63 |
| E | 1.0 | 78 | 3.9 | 20 | 67 |
| F | 9.0 | 60 | 3.6 | 20 | 46 |

The results given in Table I show that coatings chemically bonded to the nylon surface in accordance with the present invention (e.g., via a heat treatment) have good retention to the nylon surface during dyeing, as measured by the C-16 Contact Angle. The results also show the effect of the FOM/MAA molar ratio on the contact angle. The results show that the contact angle increases with FOM content of the copolymer up to a point and thereafter decreases.

EXAMPLE 2

In this example nylon carpet yarns are coated with various fluoroacrylate/acrylic acid copolymers in accordance with the present invention. Aqueous dispersions of the copolymers are prepared using the procedure described in Example 1 by copolymerizing components in which a fluoroacrylate component consisting of a mixture of perfluoroalkyl acrylates (FPA) of the formula $$CF_3(CF_2)_xCH_2CH_2OOCCH{=}CH_2,$$

where x ranges from 5 to 11, an acid component consisting of acrylic acid (AA) and a third component, when present, consisting of styrene (Sty), methyl mechacrylate (MA) or vinyl acetate (VA). The copolymers and the molar ratio of the monomers used in their preparation are given in Table II. When the third component is present the resulting copolymer is believed to be mostly a block copolymer comprising blocks composed of acrylic acid and blocks composed a random copolymer of PFA and the third component, the block copolymer being represented in Table II, for example, as AA/PFA+Sty. Each polymer is applied to a yarn from a finish comprising an aqueous dispersion of the polymer. The resultant coated yarn was heat-treated at 190° C. for 10 minutes and then blank dyed as described in Example 1. After blank-dyeing, the contact angle was determined as well as the amount of fluorine (ppm) remaining on the yarn. The amount of fluorine retained on the yarn after blank-dyeing expressed as a percentage of fluorine on the yarn before blank-dyeing (F-Retention) was also determined. The results are given in Table II.

TABLE II

| Yarn | Copolymer | Molar Ratio | F (ppm) | F-Retention % | Contact Angle (Degree) |
|---|---|---|---|---|---|
| 1 | PFA (Control) | — | 564 | 65 | 54 |
| 2 | AA/PFA | 1:1 | 655 | 99 | 60 |
| 3 | AA/PFA + Sty | 1:1:1 | 599 | 99 | 59 |
| 4 | AA/PFA + MA | 1:1:1 | 589 | 93 | 61 |
| 5 | AA/PFA + VA | 1:1:1 | 716 | 81 | 58 |
| 6 | Untreated | — | — | — | <20 |

The data given in Table II clearly show the fluorochemical-coated yarns of the present invention (yarns 2–5) lose very little of their coating during normal carpet dyeing operations. In related experiments, results similar to those shown in Table II are also obtained with yarns coated with the polymer described in Example 1, i.e. FOM/MMA, in a mole ratio of 1:1.

EXAMPLE 3

In this example, experiments are conducted to demonstrate the outstanding ability of the coated fibers of the present invention to provide carpet piling that can be foam dyed without difficulty, in particular, without loss of appearance, due to "frosting". Frosting is the appearance resulting from the presence of undyed fibers in the carpet piling which actually give the appearance of frost on the surface of the piling.

Nylon 66 carpet yarns are coated with various copolymers, polymers and FOA homopolymer as shown in Table III. An aqueous dispersion of each of the polymers listed in Table III is prepared using the general procedure described in Example 1. Each polymer is applied to the yarns from a spin finish comprising an aqueous dispersion of the polymer. The yarns are then heat treated at 190° C. for 10 minutes in an oven and then tufted to provide cut pile carpet samples. The samples are subjected to a conventional foam dyeing operation. The appearance of the dyed carpet samples is then rated on a scale ranging from 1 (worst) to 10 (best). A sample rated 1 would be strongly frosted. In another test, a drop of oil (hexadecane) is placed on top of the pile of the dyed carpet and the time required for the drop to be absorbed by the pile is recorded. The results of the experiment are given in Table III.

TABLE III

| Yarn | Coating | Molar Ratio | F on Fiber (ppm) | F* (%) | Oil Drop Test | Foam Dyeing |
|---|---|---|---|---|---|---|
| 1 | None | — | — | — | Zero | 10 |
| 2 | AA/FOA | 3:1 | 560 | 87 | 3 days | 10 |
| 3 | AA/FOA + VA | 1:1:1 | 650 | 100 | 3 days | 9 |
| 4 | AA/FOA + MA | 1:1:1 | 710 | 81 | 3 days | 10 |
| 5 | AA/FOA + MA | 1:1:1 | 690 | 93 | 2 days | 10 |
| 6 | AA/FOA + Sty | 1:1:1 | 600 | 99 | sev. hrs | 3 |
| 7 | FOA homopolymer | | 560 | 65 | 3 days | 6 |

*Fluorine retention

It is contemplated that instead of treating fibers with the copolymers described in the above examples copolymers may be used in which the fluorine-containing units

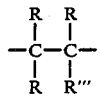

thereof are provided by using a sulfonamide in addition to or instead of the fluorine-containing monomers described therein. Suitable sulfonamides include those commercially available and of the formula

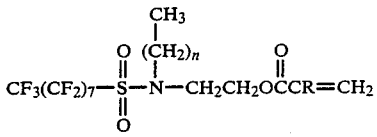

where n is 0, 1, 2, or 3 and R is preferably —H or —$CH_3$.

What is claimed is:

1. A coated polyamide fiber comprising a polyamide fiber coat with a copolymer having a carbon-carbon backbone with substituent groups pendant therefrom some of which contain fluorine atoms attached directly to aliphatic carbon atoms and others of which are reactive groups capable of reacting with amide linkages of the polyamide fiber and wherein the copolymer coating is chemically bonded to the fiber between said reactive groups and said amide linkages of the polyamide fiber, and, wherein said coated fiber comprises sufficient fluorine atoms to provide at least 100 ppm of fluorine, based on the weight of fiber.

2. The coated fiber of claim 1 wherein said reactive groups are carboxylic acid groups.

3. The coated fiber of claim 2 wherein said polyamide is nylon 66.

4. The coated fiber of claim 3 in the form of a yarn.

5. A coated polyamide fiber comprising a polyamide fiber coated with a polymer comprising recurring units of the formula

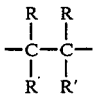

and recurring units of the formula

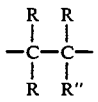

wherein the polymer coating is chemically bonded to the fiber between R′ groups of said polymer and said amide linkages

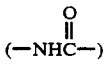

of said polyamide fiber, and wherein R′ is a group capable of reacting with amide linkages of polyamides, R″ is a group containing fluorine atoms attached directly to aliphatic carbon atoms and R is hydrogen or a group nonreactive with said polyamide, said product comprising sufficient fluorine atoms to provide at least 100 ppm of fluorine based on the weight of fiber.

6. The fiber of claim 5 wherein R′ is a carboxylic acid group.

7. The fiber of claim 6 wherein said polyamide is a nylon.

8. The fiber of claim 7 in the form of a coated yarn.

9. The coated yarn of claim 8 wherein R is

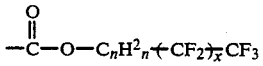

10. The coated yarn of claim 8 wherein R is hydrogen or methyl and R″ is

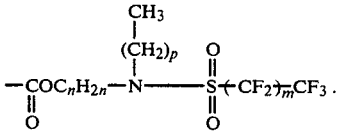

where n is 0, 1 or 2; and x is an integer from 5 to 11, inclusive; p is 0, 1, 2 or 3; and m is an integer from 3 to 15, inclusive.

11. The coated yarn of claim 10 wherein said polyamide is nylon 66.

12. The coated yarn of claim 10 wherein said addition polymer also contains repeating units of the formula

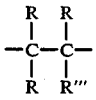

where R‴ is a group which is nonreactive with amide linkages.

13. The coated yarn of claim 12 wherein R‴ is a phenyl group.

14. The coated yarn of claim 12 wherein R‴ is

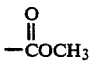

15. The coated yarn of claim 12 wherein R‴ is

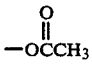

* * * * *